US009353643B2

(12) United States Patent
Major

(10) Patent No.: US 9,353,643 B2
(45) Date of Patent: May 31, 2016

(54) VARIABLE STATOR VANE ASSEMBLY FOR A TURBINE ENGINE

(75) Inventor: Daniel W. Major, Middletown, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 2497 days.

(21) Appl. No.: 11/733,242

(22) Filed: Apr. 10, 2007

(65) Prior Publication Data

US 2009/0317241 A1 Dec. 24, 2009

(51) Int. Cl.
*F01D 17/12* (2006.01)
*F01D 17/16* (2006.01)

(52) U.S. Cl.
CPC ..... *F01D 17/162* (2013.01); *F05D 2260/37* (2013.01); *Y10T 29/49323* (2015.01)

(58) Field of Classification Search
CPC ..... F01D 17/162; Y10T 29/49323; F05D 2260/37
USPC ..... 415/160, 161, 165, 191, 209.4
See application file for complete search history.

(56) References Cited

U.S. PATENT DOCUMENTS

| | | | | |
|---|---|---|---|---|
| 4,025,227 | A * | 5/1977 | Greenberg et al. | 415/160 |
| 4,773,821 | A * | 9/1988 | Gonthier et al. | 415/150 |
| 4,808,069 | A * | 2/1989 | Bonner et al. | 415/160 |
| 4,990,056 | A * | 2/1991 | McClain et al. | 415/160 |
| 5,031,304 | A * | 7/1991 | Shepard et al. | 29/700 |
| 5,141,394 | A * | 8/1992 | Donlan | 415/190 |
| 5,308,226 | A * | 5/1994 | Venkatasubbu et al. | 415/160 |
| 5,492,446 | A * | 2/1996 | Hawkins et al. | 415/160 |
| 5,622,473 | A * | 4/1997 | Payling | 415/160 |
| 5,796,199 | A * | 8/1998 | Charbonnel | 310/90 |
| 6,129,512 | A * | 10/2000 | Agram et al. | 415/160 |
| 6,170,990 | B1 * | 1/2001 | Hawkins | 384/297 |
| 6,481,960 | B2 * | 11/2002 | Bowen | 415/160 |
| 6,602,049 | B2 * | 8/2003 | Caubet et al. | 415/160 |
| 6,682,299 | B2 * | 1/2004 | Bowen et al. | 415/160 |
| 6,767,183 | B2 * | 7/2004 | Schilling et al. | 415/160 |
| 7,112,039 | B2 * | 9/2006 | Brooks | 415/156 |
| 7,281,892 | B2 * | 10/2007 | Lejars et al. | 415/160 |
| 7,530,784 | B2 * | 5/2009 | Ribassin et al. | 415/160 |

(Continued)

FOREIGN PATENT DOCUMENTS

| | | |
|---|---|---|
| EP | 1400659 A1 | 3/2004 |
| EP | 1524412 A2 | 4/2005 |
| EP | 1524413 A2 | 4/2005 |

OTHER PUBLICATIONS

Extended European Search Report for Application No. EP 08 25 1043 dated Sep. 6, 2011.

*Primary Examiner* — Edward Look
*Assistant Examiner* — Aaron R Eastman
(74) *Attorney, Agent, or Firm* — Carlson, Gaskey & Olds, P.C.

(57) ABSTRACT

A stator assembly for a turbine engine includes a support structure, such as an outer case, providing a bore. A non-metallic bushing is arranged in the bore and extends radially between inner and outer diameters providing a one-piece structure. The outer diameter of the bushing engages the bore in a press-fit relationship, in one example. A stator includes a trunnion arranged within and engaging the bushing inner diameter. In one example, the non-metallic bushing is constructed from an electrographitic carbon. The bushing is installed into the bore such that an end of the bushing is generally flush with or recessed from a wall on the support structure.

7 Claims, 4 Drawing Sheets

(56) References Cited

U.S. PATENT DOCUMENTS

| | | | | |
|---|---|---|---|---|
| 2002/0061249 | A1* | 5/2002 | Caubet et al. | 415/160 |
| 2002/0154991 | A1* | 10/2002 | Bowen | 415/160 |
| 2003/0147743 | A1* | 8/2003 | Chatel et al. | 415/160 |
| 2004/0240991 | A1* | 12/2004 | Bruce | 415/160 |
| 2005/0175445 | A1* | 8/2005 | Lejars et al. | 415/160 |
| 2006/0029494 | A1* | 2/2006 | Bruce et al. | 415/160 |
| 2006/0110246 | A1 | 5/2006 | Bruce | |
| 2006/0285969 | A1* | 12/2006 | Maurice Ribassin et al. | 415/160 |
| 2007/0059161 | A1* | 3/2007 | Bouru | 415/160 |
| 2007/0160463 | A1* | 7/2007 | Jahns | 415/160 |
| 2007/0160464 | A1* | 7/2007 | Lesnevsky et al. | 415/160 |

* cited by examiner

VARIABLE STATOR VANE ASSEMBLY FOR A TURBINE ENGINE

BACKGROUND

This application relates to a bearing for use in supporting a stator trunnion. This application also relates to a method of installing the bearing into a support structure.

A turbine engine typically includes multiple compressor stages. Circumferentially arranged stators are arranged axially adjacent to the compressor blades, which are supported by a rotor. Some compressors utilize variable stator vanes in which the stators are supported for rotation by an outer case. The stator vanes are actuated between multiple angular positions to change the operating characteristics of the compressor.

An outer diameter of the stator vane includes a trunnion that is supported by a bushing in the outer case. The outer case includes an axially outwardly extending boss providing a bore that receives the bushing. One typical bushing includes a two-piece construction. An outer titanium sleeve is press-fit within the bore. A transfer molded composite bearing liner, for example a braided carbon fiber polyimide resin, is arranged at the inner diameter of the titanium sleeve. The composite bearing liner provides a low friction surface for supporting the trunnion.

Excessive temperatures in the compressor significantly degrade the resin binder and thereby reduce the bushing's life. Typically, the bushing degrades by delaminating or disintegrating when subjected to sustained temperatures at these excessive temperatures. Once the bearing liner fails, the titanium sleeve begins to wear and the vane angle is affected. What is needed is a bushing with greater heat tolerance and extended life.

SUMMARY

A stator assembly for a turbine engine includes a support structure, such as an outer case, providing a bore. A non-metallic bushing is arranged in the bore and extends radially between inner and outer diameters providing a one-piece structure. The outer diameter of the bushing engages the bore in a press-fit relationship, in one example. A stator includes a trunnion arranged within and engaging the bushing inner diameter. In one example, the non-metallic bushing is constructed from an electrographitic carbon. The bushing is installed into the bore such that an end of the bushing is generally flush with or recessed from a wall on the support structure.

These and other features of the application can be best understood from the following specification and drawings, the following of which is a brief description.

DETAILED DESCRIPTION OF THE PREFERRED EMBODIMENT

Figure 1:
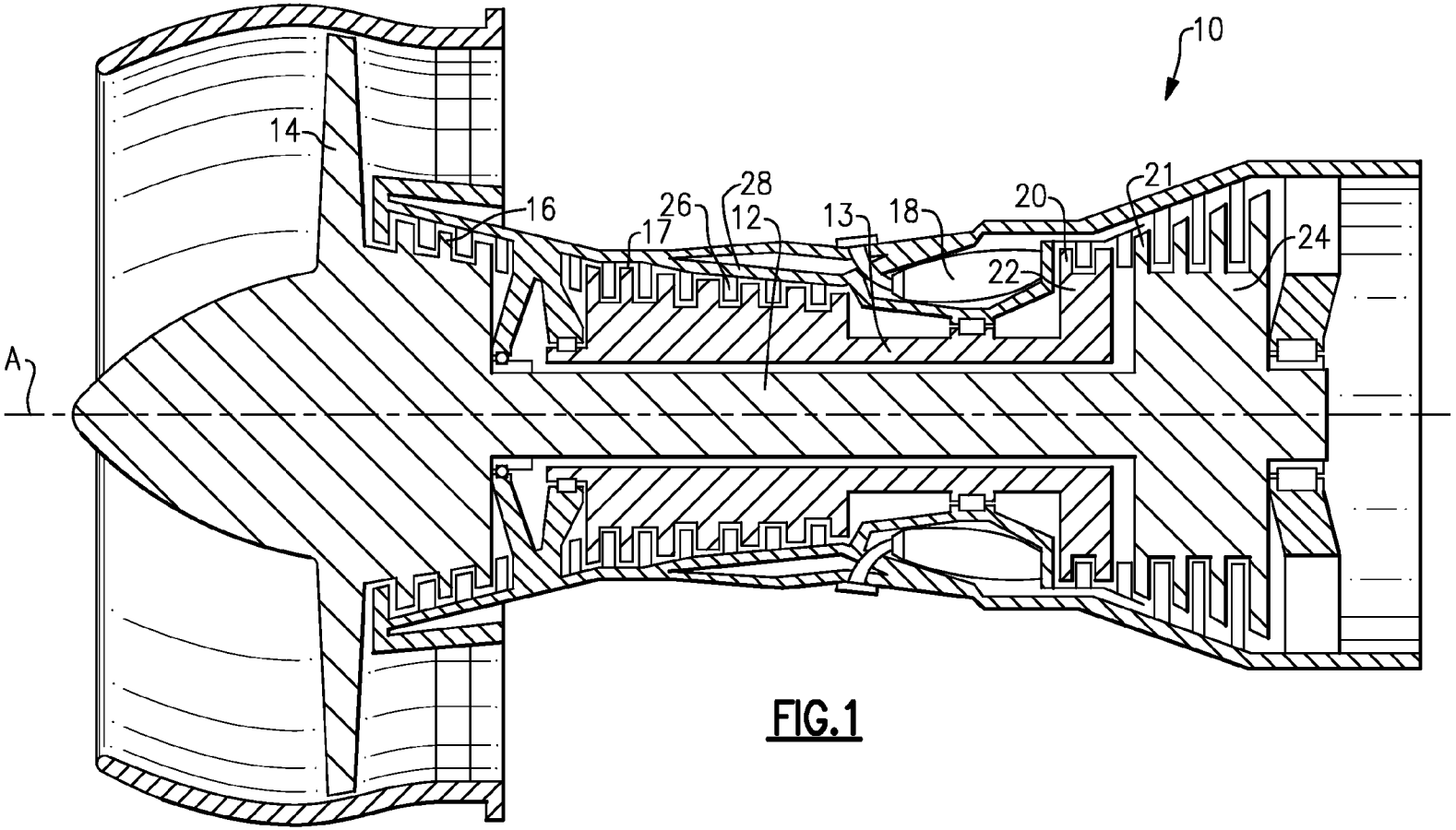
FIG. 1 is a simplified cross-sectional view of an example turbine engine.

One example turbine engine 10 is shown schematically in FIG. 1. As known, a fan section moves air and rotates about an axis A. A compressor section, a combustion section, and a turbine section are also centered on the axis A. FIG. 1 is a highly schematic view, however, it does show the main components of the gas turbine engine. Further, while a particular type of gas turbine engine is illustrated in this figure, it should be understood that the claim scope extends to other types of gas turbine engines, including geared turbofan engines.

The engine 10 includes a low spool 12 rotatable about an axis A. The low spool 12 is coupled to a fan 14, a low pressure compressor 16, and a low pressure turbine 24. A high spool 13 is arranged concentrically about the low spool 12. The high spool 13 is coupled to a high pressure compressor 17 and a high pressure turbine 22. A combustor 18 is arranged between the high pressure compressor 17 and the high pressure turbine 22.

The high pressure turbine 22 and low pressure turbine 24 typically each include multiple turbine stages. A hub supports each stage on its respective spool. Multiple turbine blades are supported circumferentially on the hub. High pressure and low pressure turbine blades 20, 21 are shown schematically at the high pressure and low pressure turbines 22, 24. Stator vanes 26 are arranged between the different blade stages and may be of fixed or variable geometry.

Figure 2:
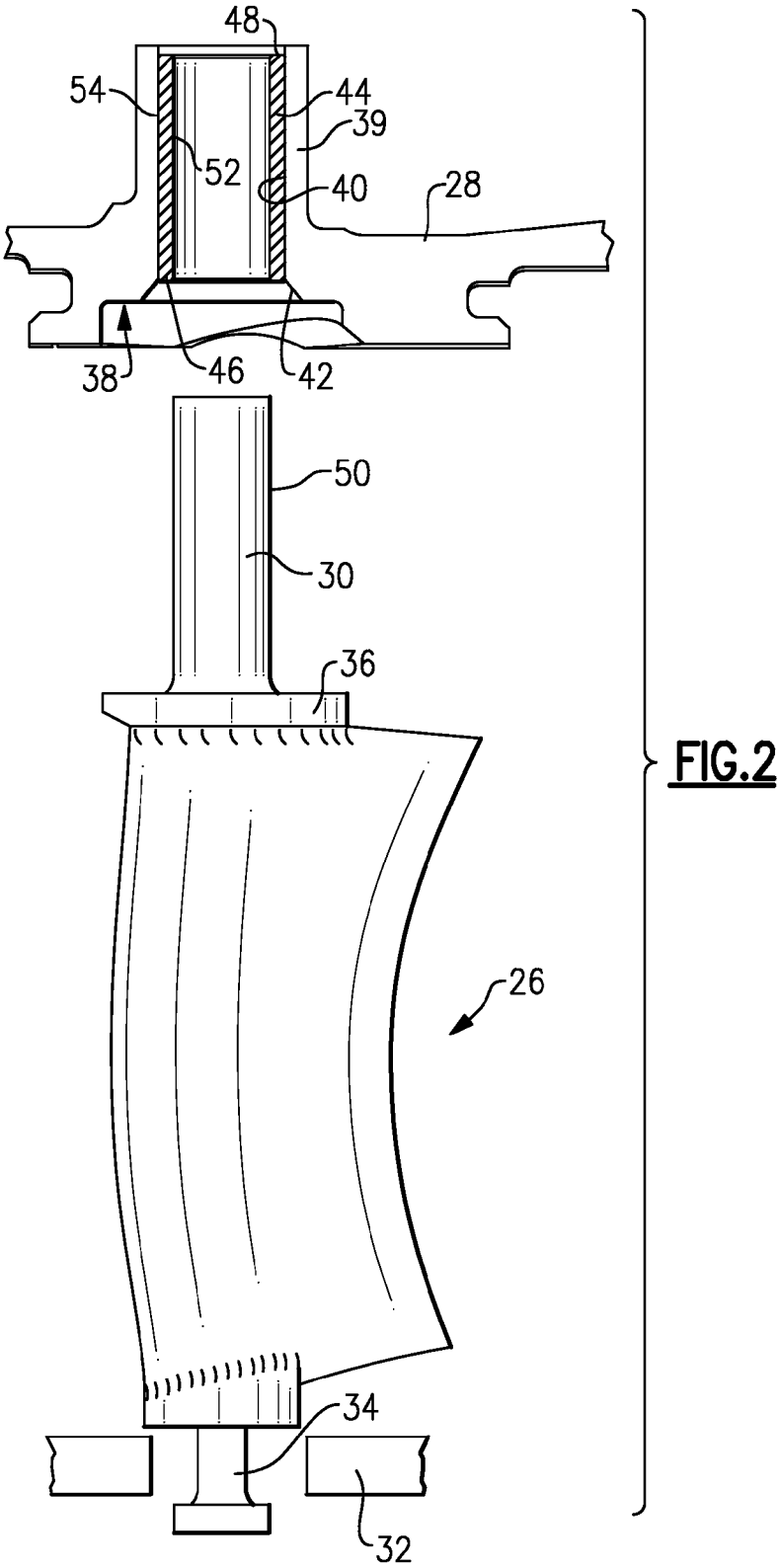
FIG. 2 is an exploded view of a variable stator assembly.

Referring to FIG. 2, one variable stator vane 26 is shown in more detail. The stator vane 26 includes inner and outer trunnions 34, 30 respectively supported by an inner and outer case 32, 28. The outer case 28 (also shown schematically in FIG. 1) includes a recess 38 that accommodates an outer platform 36 at a junction between the outer trunnion 30 and vane 26.

Figure 3:
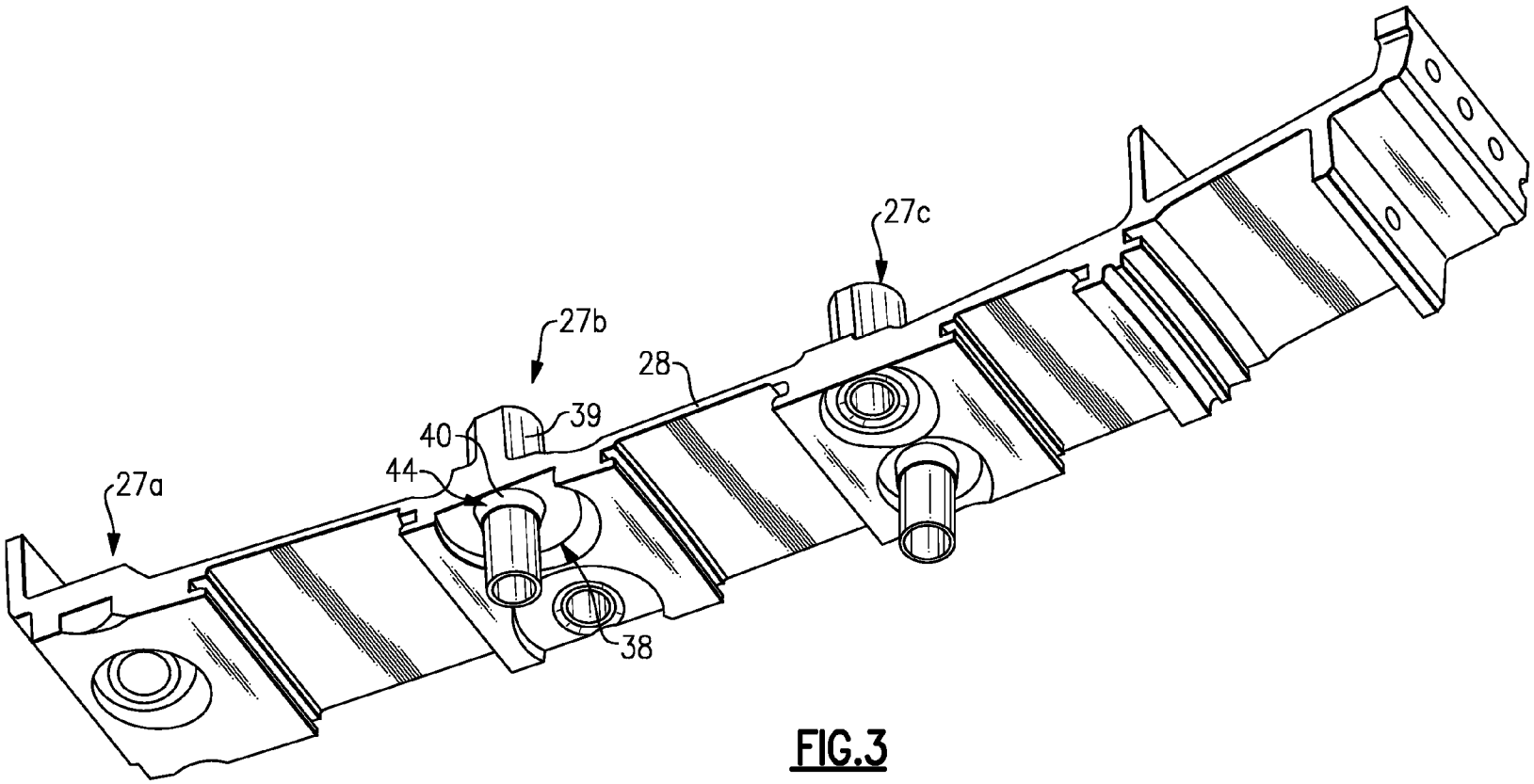
FIG. 3 is a perspective sectional view of a portion of an outer case with a bushing for supporting the stator prior to installation.

Referring to FIGS. 2 and 3, the outer case 28 includes a boss 39 extending radially outward from the recess 38. The boss 39 has a bore 40 that receives a bushing 44 in a press-fit relationship. A chamfer 42 interconnects and extends between the recess 38 and bore 40 to facilitate installation of the bushing 44 into the outer case 28. As shown in FIG. 3, an engine may include variable stator vanes arranged at multiple axial compressor stages 27*a*-27*c*.

In one example, the bushing 44 is a unified construction of a non-metallic material. The non-metallic material extends radially from an inner diameter surface 52, which engages an outer trunnion outer diameter surface 50, to an outer diameter surface 54 that engages the bore 40. In one example, the bushing 44 is constructed from an electrographitic carbon. One type of electrographitic carbon is sintered to approximately 4,000° F. during its formation. The electrographitic carbon can be brittle and subject to fracture if unsupported. To this end, it is desirable to install the bushing 44 into the bore 40 so that one or both of ends 46, 48 are supported within the bore 40.

Figure 4B:
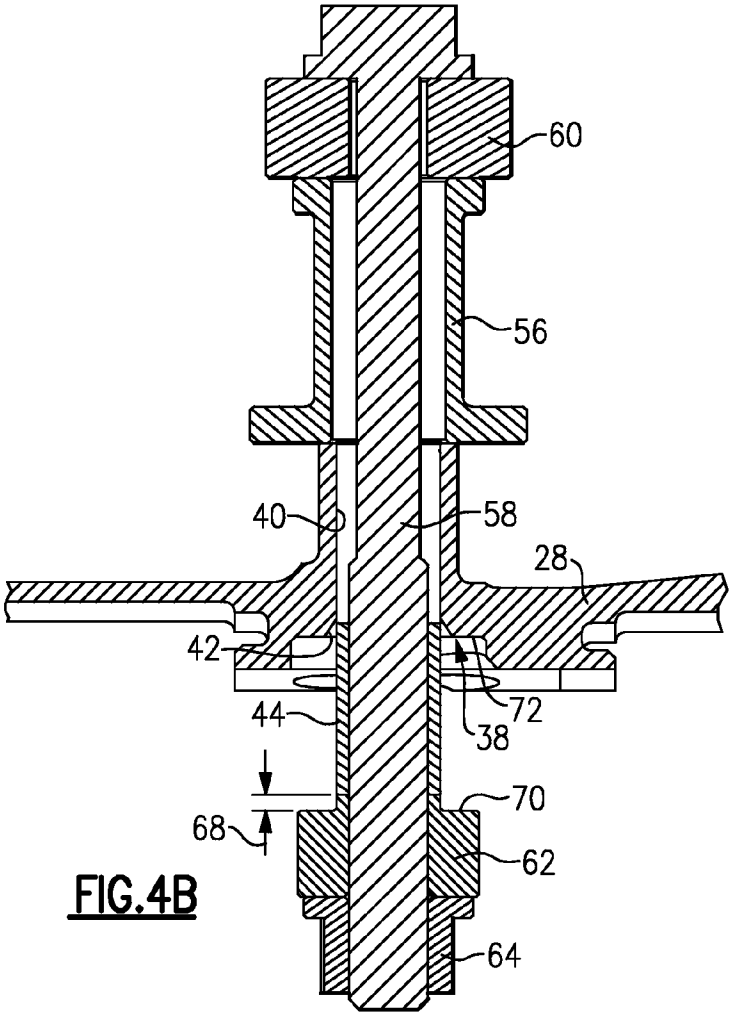
FIG. 4B is a cross-sectional view of the installation tool and bushing prior to the bushing positioned in the installed position.
Figure 4A:
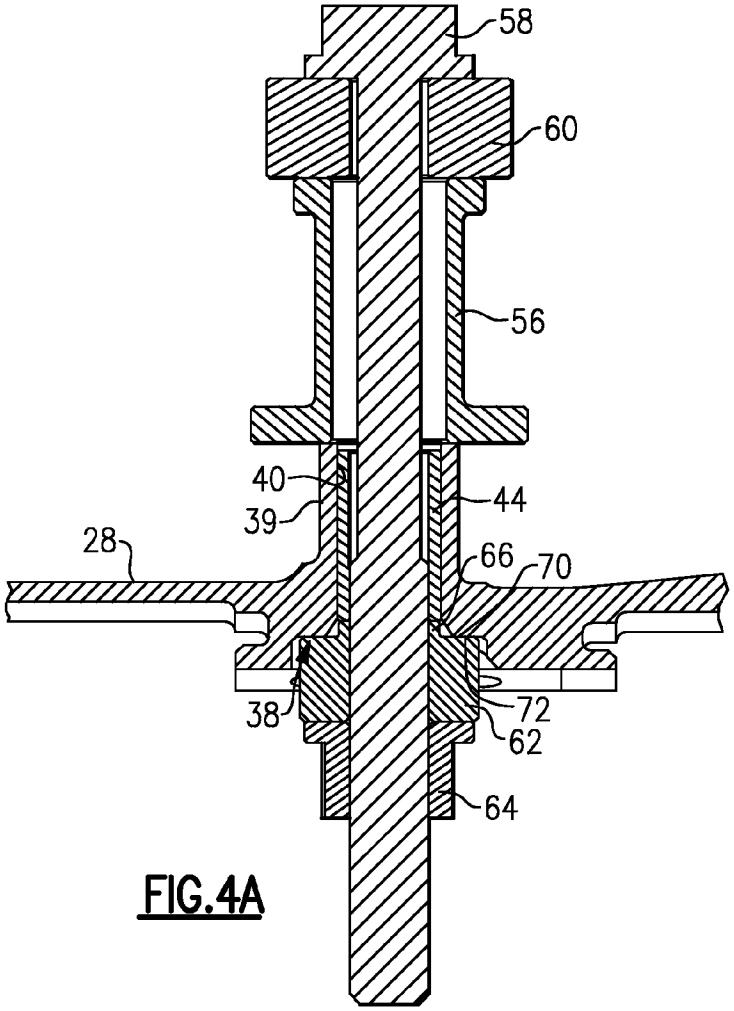
FIG. 4A is a cross-sectional view of an installation tool with the bushing in an installed position.

Referring to FIGS. 4A and 4B, the bushing 44 is initially arranged at the inner diameter of the outer case 28 for installation. A tool typically employed for bushing installation can be used. However, an adapter 62 having a protrusion 66 is also provided to ensure the inner end 46 of the bushing 44 is installed to a desired radial depth 68, in one example, that does not leave the end 46 undesirably exposed and unsupported. In one example, the inner end 46 is generally flush with the intersection of the chamfer 42 and bore 40. A shoulder 70 of the adapter 62 seats against a wall 72 provided by a bottom of the recess 38. The inner end 46 is recessed from the wall 72.

In operation, during installation, a sleeve 56 abuts the boss 39. A spacer 60 is arranged adjacent to the sleeve 56 opposite the boss 39. A threaded fastener 58 extends through the spacer 60, sleeve 56, bushing 44 and adapter 62. A nut 64 is secured to the fastener 58 near the adapter 62. The fastener 58 is tightened to draw the bushing 44 into the bore 40 in an interference fit. The shoulder 70 seats against the wall 72 thereby ensuring that the bushing 44 has been inserted into the bore 40 to the desired radial depth 68, thus ensuring adequate support to prevent damage. Of course, other installation tooling arrangements may be used.

Although a preferred embodiment has been disclosed, a worker of ordinary skill in this art would recognize that certain modifications would come within the scope of the claims. For that reason, the following claims should be studied to determine their true scope and content.

What is claimed is:

1. A stator assembly for a turbine engine comprising:

an outer case providing a bore;

a non-metallic bushing arranged in the bore in an interference fit relationship and extending radially between inner and outer diameters, the outer diameter engaging the bore;

a stator including a trunnion arranged within and engaging the bushing inner diameter;

wherein the trunnion is an outer trunnion received within the bore;

wherein the outer case provides a boss having the bore and extending away from the stator in an axial direction of the bore; and wherein the outer case provides a recess defining a wall surface, and the bore extends radially outwardly from the recess of the outer case.

2. The stator assembly according to claim 1, wherein a chamfer is provided in the outer case and extends between the recess and the bore, the recess arranged on an inner side of the outer case and opposite the boss.

3. The stator assembly according to claim 2, wherein the non-metallic bushing includes an inner end that is flush with an intersection between the chamfer and the bore, the inner end recessed from the wall surface, and the non-metallic bushing includes an outer end opposite the inner end and recessed into the bore.

4. The stator assembly according to claim 3, wherein the non-metallic bushing is cylindrical in shape with a uniform diametral cross-section, the non-metallic bushing arranged entirely within the bore.

5. The stator assembly according to claim 1, wherein the non-metallic bushing is constructed from an electrographitic carbon.

6. A stator assembly for a turbine engine comprising:

an outer case providing a bore;

a non-metallic bushing arranged in the bore in an interference fit relationship and extending radially between inner and outer diameters, the outer diameter engaging the bore; and a stator including a trunnion arranged within and engaging the bushing inner diameter wherein the non-metallic bushing is cylindrical in shape with a uniform diametral cross-section.

7. The stator assembly according to claim 6, wherein the non-metallic bushing is constructed from an electrographitic carbon.

* * * * *